United States Patent [19]

Okamoto et al.

[11] Patent Number: 4,875,721

[45] Date of Patent: Oct. 24, 1989

[54] LATCH ASSEMBLY FOR DOOR OR WINDOW OF MICROWAVE RANGE

[75] Inventors: Kenzo Okamoto, Osaka; Fumihiko Kitada, Neyagawa, both of Japan

[73] Assignee: Imanishi Kinzoku Kogyo Kabushiki Kaisha, Osaka, Japan

[21] Appl. No.: 269,675

[22] Filed: Nov. 10, 1988

[51] Int. Cl.[4] ..... F05C 9/00

[52] U.S. Cl. ..... 292/29; 292/DIG. 69; 292/30; 292/DIG. 37; 292/221; 126/197

[58] Field of Search ..... 292/29, 30, 52, 53, 292/126, 127, DIG. 37, DIG. 69, 254, 221, 226, 227; 49/305, 503; 219/10.55 C; 126/197; 200/61.62, 61.64

[56] References Cited

U.S. PATENT DOCUMENTS

| | | | |
|---|---|---|---|
| 3,865,097 | 2/1975 | Robinson | 292/DIG. 69 |
| 4,006,121 | 2/1977 | Isono | 200/61.64 |
| 4,341,409 | 7/1982 | Sakoda | 292/254 |
| 4,450,335 | 5/1984 | Shimizu et al. | 219/10.55 C |
| 4,497,993 | 2/1985 | Aoyama | 126/197 |
| 4,509,779 | 4/1985 | Sasaki | 292/DIG. 61 |
| 4,542,269 | 9/1985 | Sakoda | 126/197 |
| 4,638,137 | 1/1987 | Kazumi | 219/10.55 C |
| 4,755,647 | 7/1988 | Nishikawa et al. | 200/61.62 |
| 4,764,648 | 8/1988 | Resh | 200/61.62 |

*Primary Examiner*—Gary L. Smith
*Assistant Examiner*—Eric Nicholson

[57] ABSTRACT

A latch assembly for a cabinet door of a microwave range is provided with a pivotal hook member of the cabinet door, which member is engaged with a dog projection of a hook housing mounted in a door-opening frame of a main body of the microwave range. On a peripheral portion of a cooking cabinet contained in the main body is fixedly mounted a door-opening frame on which is pivotally mounted a hook-operating lever in a lower-end portion of which is slidably mounted one end of a hook-operating rod the other end of which is brought into contact with the pivotal hook member of the cabinet door, the hook-operating rod being normally biased at its retracted position by a spring means. An upper-end portion of the hook-operating lever is brought into contact with a push pin portion of a push button which is mounted in a control panel of the microwave range in a retractable manner.

8 Claims, 3 Drawing Sheets

LATCH ASSEMBLY FOR DOOR OR WINDOW OF MICROWAVE RANGE

BACKGROUND OF THE INVENTION

1. Field of the Invention

The present invention relates to a latch assembly for a cabinet door or window of a microwave range, and more particularly to a latch assembly for a cabinet door or window of an upright-type microwave range provided with a cavity or cooking cabinet in an upper portion of which are disposed main components of the microwave range, i.e., a high-frequency oscillator or magnetron and its auxiliary components so that the microwave range requires less space in its floor area relative to a volume capacity of its cooking cabinet.

2. Description of the Prior Art

As is well known, in the microwave range, a high-frequency oscillator or magnetron produces microwave energy which is supplied through a wave-guide to a food stuff received in a cavity or cooking cabinet of the microwave range so as to cook the food stuff. From the viewpoint of space saving, it is general to dispose a circuit of the high-frequency oscillator or magnetron on the cooking cabinet. Consequently, it is very difficult to dispose a latch assembly of a microwave range door or cabinet door on the cooking cabinet in addition to the circuit of the magnetron. As a result, the latch assembly of the cabinet door is substantially housed in a small side clearance defined between an outer casing of the microwave range and the cooking cabinet contained therein. However, it is very difficult that the latch assembly is housed in such small side clearance so as to be manually controlled in an easy manner through a push button arranged in a control panel positioned on the cooking cabinet. This ~~is a~~ problem inherent in the conventional microwave range.

SUMMARY OF THE INVENTION

It is an object of the present invention to provide a latch assembly for a door or window of an upright-type microwave range in which: the latch assembly is housed in a small side clearance between an outer casing of the microwave range and a cavity or cooking cabinet contained therein so as to be manually controlled in an easy manner through a push button arranged in a control panel positioned on the cooking cabinet of the microwave range.

According to the present invention, there is provided:

In a latch assembly for a cabinet door or window of an upright-type microwave range provided with an outer casing and a cavity or cooking cabinet contained in the the cabinet door being pivotally mounted on a front portion or door-opening frame of the outer casing while provided with a pivotal hook member which is engaged with a dog projection of a hook housing mounted in the door-opening frame of the outer casing, the improvement wherein: on a peripheral portion of the cooking cabinet is fixedly mounted the door-opening frame on which is pivotally mounted a hook-operating lever in a lower-end portion of which is slidably mounted one end of a hook-operating rod the other end of which is brought into contact with the pivotal hook member of the cabinet door, the hook-operating rod being normally biased at its retracted position by a spring means; and an upper-end portion of the hook-operating lever is brought into contact with a push pin which is integrally formed with a push button in a projecting manner, the push button being mounted in a control panel of the microwave range in a retractable manner.

In the microwave range of the present invention, the hook-operating rod mounted in the outer casing can protrudes from the outer casing toward the cabinet door so as to disengage the pivotal hook member of the cabinet door from the dog projection of the hook housing mounted in the door-opening frame of the cooking cabinet.

In operation, in the microwave range of the present invention, when the push button mounted in the control panel of the microwave range is depressed, the push pin of the push button pushes the upper-end portion of the hook-operating lever mounted on the door-opening frame of the outer casing. As a result, the hook-operating lever is rotated clockwise so that the lower-end portion of the hook-operating lever pushes the hook-operating rod so as to protrude the same from the door-opening frame of the outer casing, whereby the pivotal hook member of the cabinet door is rotated counter-clockwise to cause its hook projection to disengage from the dog projection of the hook housing mounted in the door-opening frame of the outer casing. The cabinet door is preferably provided with a second pivotal hook member which is substantially identical in construction with the pivotal hook member described above while spaced apart from the same by a predetermined distance and connected therewith through a connecting rod.

In operation, in the microwave range of the present invention, when the push button mounted in the control panel of the microwave range is depressed, the push pin of the push button pushes the upper-end portion of the hook-operating lever mounted on the door-opening frame of the outer casing. As a result, the hook-operating lever is rotated clockwise so that the lower-end portion of the hook-operating lever pushes the hook-operating rod so as to protrude the same from the door-opening frame of the outer casing. Once the pivotal hook member of the cabinet door is rotated counter-clockwise by the thus protruded hook-operating rod to cause its hook projection to disengage from the dog projection of the hook housing mounted in the door-opening frame of the outer casing, the protruded hook-operating rod is preferably withdrawn into the door-opening frame of the outer casing.

BRIEF DESCRIPTION OF THE DRAWINGS

F 1 is a partial perspective view of the microwave range with the latch assembly of the present invention for the cabinet door or window of the microwave range.

DESCRIPTION OF THE PREFERRED EMBODIMENTS

An embodiment of the latch assembly of the present invention for a cabinet door or window of the microwave range will be hereinbelow described in detail with reference to the drawings. It is clear that the present invention is not limited only to this embodiment.

Figure 1:
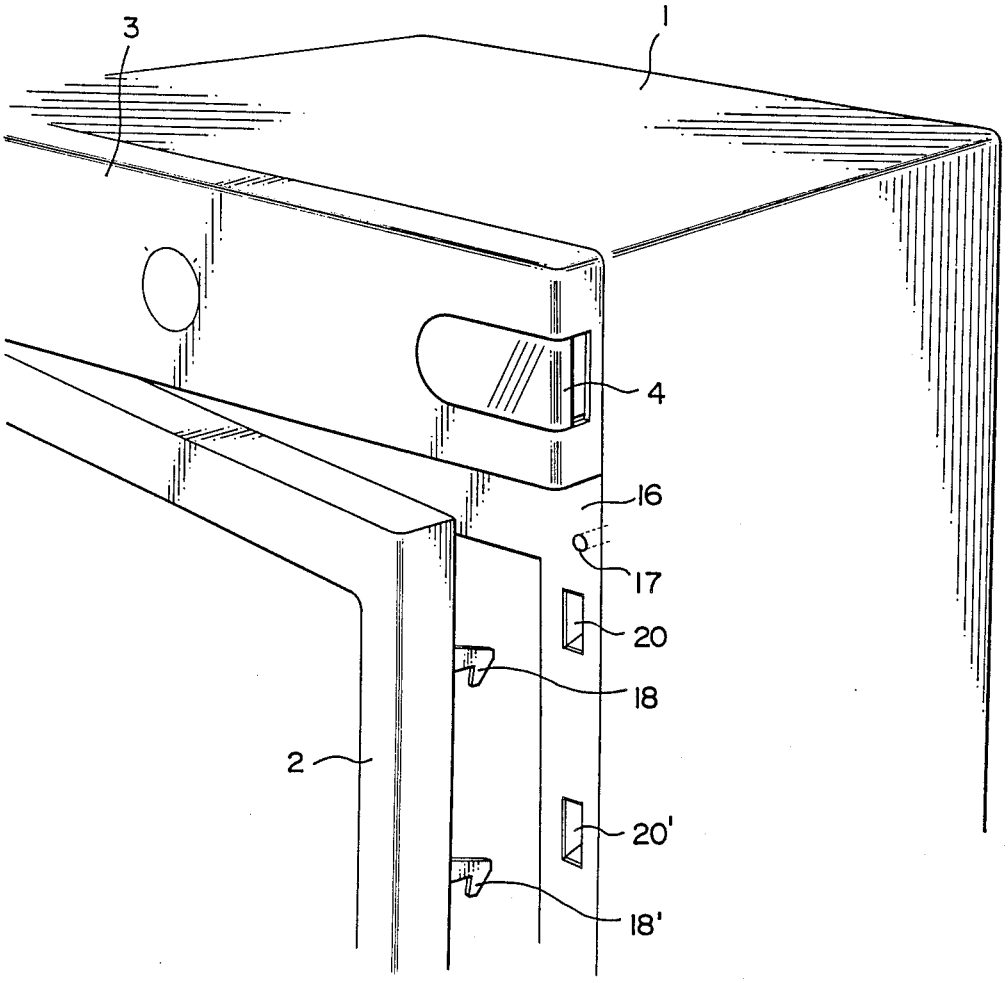
Figure 2:
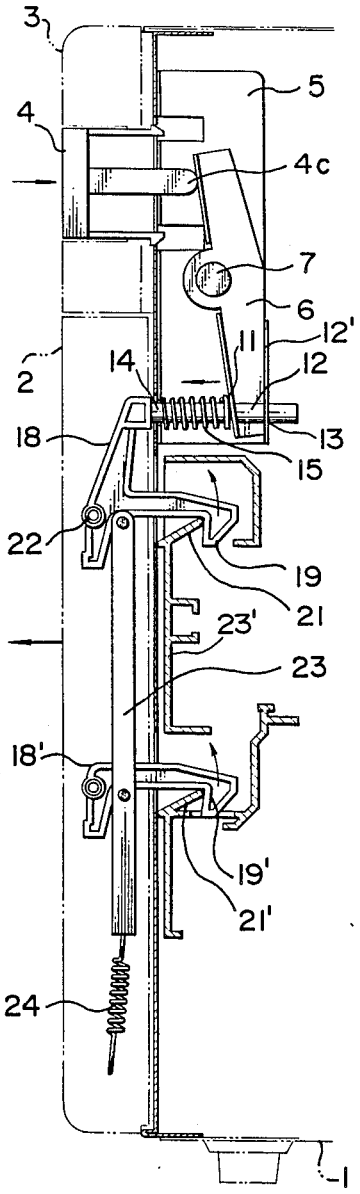
FIG. 2 is a longitudinal sectional view of the latch assembly of the present invention shown in FIG. 1 in a condition in which the cabinet door or window of the range is closed.
Figure 3:
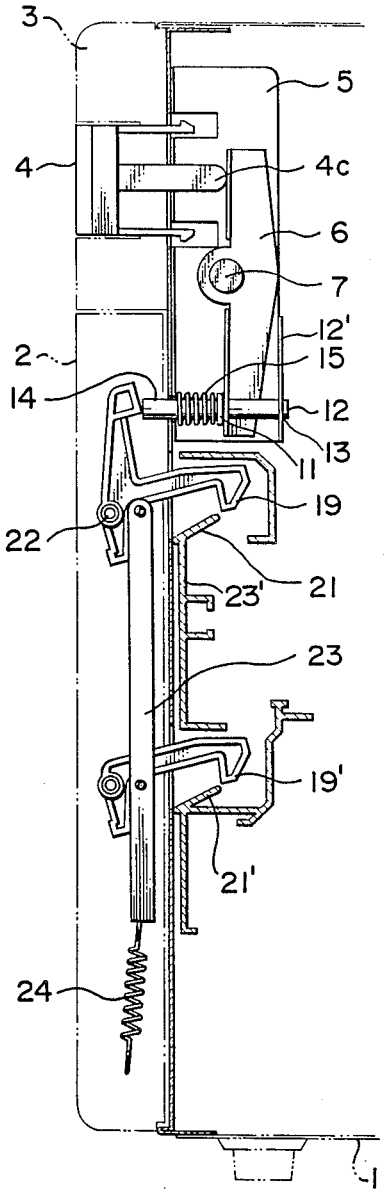
FIG. 3 is a longitudinal sectional view of the latch assembly of the present invention shown in FIG. 1 in a condition in which the cabinet door or window of the range is opened.
Figure 4:
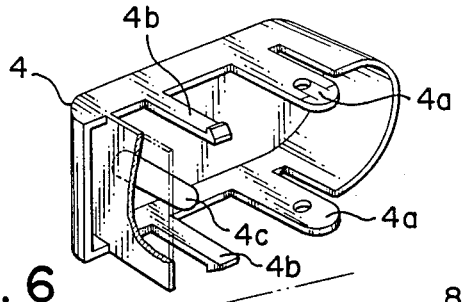
FIG. 4 is a perspective view of the push button employed in the latch assembly of the present invention.
Figure 5:
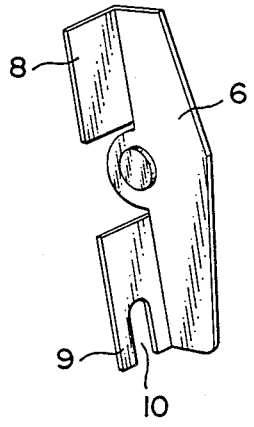
FIG. 5 is a perspective view of the hook-operating lever of the latch assembly of the present invention.
Figure 6:
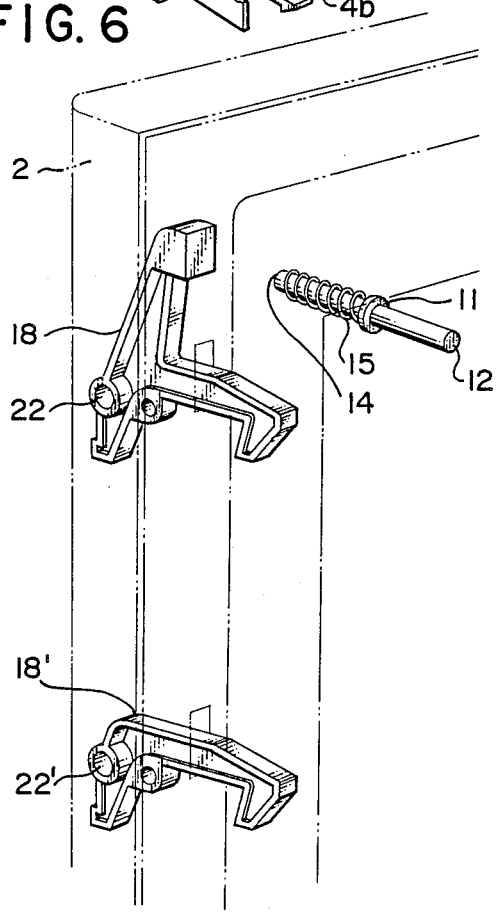
FIG. 6 is a perspective view of the hook members of the latch assembly of the present invention.

In the drawings: the reference numeral 1 denotes an outer casing of the microwave range, the outer casing 1 being constructed of a metallic plate; 2 a cabinet door pivotally mounted on a door-opening frame 16 of the microwave range; and 3 a control panel arranged in an upper portion of the microwave range. In the interior of the upper portion of the microwave range are provided: a high-frequency oscillator or magnetron; a high-tension transformer; a time switch., a defrosting switch; a fan motor and the like, all of which are not shown in the drawings. A push button 4, which is depressed to open the cabinet door 2, is provided at a right-hand corner of the control panel 3 as shown in FIG. 1. As shown in FIG. 4, the push button 4 is integrally provided with a pair of upper and lower support plate portions 4*a* and a pair of upper and lower hook-like stopper portions 4*b* which are horizontally spaced apart from the support plate portions 4*a* and prevents the push button 4 from dropping out of the control panel 3 of the microwave range. The push button 4 is pivotally mounted on the control panel 3 at its support plate portions 4*a*. The push button 4 is further integrally provided with a push pin portion 4*c* extending horizontally toward the inside of the microwave range. As shown in FIGS. 2 and 3, a lever-support plate 5 for pivotally support a hook-operating lever 6 through a lever-support axle 7 is fixedly mounted on the outer casing 1 so as to be housed in a small side clearance between a cooking cabinet of the microwave range and the outer casing 1. As is clear from FIG. 5, the hook-operating lever 6 is provided with upper and lower bent tab portions 8 and 9. The upper bent tab portion 8 of the hook-operating lever 6 is constantly brought into contact with the push pin portion 4*c* of the push button 4. On the other hand, the lower bent tab portion 9 of the push button 4 is provided with a vertical slot 10 in which is slidably received a hook-operating rod 12 which is provided with a flange 11 at its substantially intermediate portion. One end of the hook-operating rod 12 is slidably inserted into a through-hole 13 formed in a bent tab portion 12 of the lever support plate 5, the bent tab 12 portion being illustrated at the right-hand end of the lever-support plate 5 in FIGS. 2 and 3. On the other hand, the other end of the hook-operating rod 12 is inserted into a compression coil spring 15 to carry the same and further inserted into a through-hole 17 formed in a door-opening frame 16 of the outer casing 1.

As shown in FIGS. 1 to 3, the other end of the hook-operating rod 12 passed through the through-hole 17 of the door-opening frame 16 of the outer casing 1 is constantly and resiliently brought into contact with a top-end portion of a hook member 18 which is pivotally mounted in the pivotal cabinet door 2. The hook member 18 assumes a substantially L-shaped form, and is provided with a hook-like projection 19 while pivotally mounted on an axle 22 secured to the cabinet door 2. When the cabinet door 2 is closed, the hook-like projection 19 of the hook member 18 is inserted into a receiving hole 20 of the door-opening frame 16 of the outer casing 1 so as to engage with a dog projection 21 of a hook housing 23 which is made of electrical-insulating material and fixedly mounted in the door-opening frame 16 of the outer casing 1. The hook member 18 is vertically spaced apart from a second hook member 18 by a predetermined distance, while connected therewith through a connecting rod 23 so as to be mechanically interlocked therewith. The second hook member 18. Assumes the substantially same shape as that of the hook member 18. A lower end of the connecting rod 23 is connected to a tension spring 24 so that the connecting rod 23 is constantly biased downward.

As is clear from FIGS. 2 and 3, the hook housing 23 is provided with a second dog projection 21 together with the dog projection 21. Consequently, when the cabinet door 2 is closed, a second hook projection 19 of the second hook member 18, and the hook projection 19 of the hook member 18 are inserted into a second receiving hole 20 and the receiving hole 20 of the door-opening frame 16 to engage with the second dog projection 21 and the dog projection 21 of the hook housing 23, respectively. A micro-switch (not shown), which is disposed on the hook housing 23, is turned on when the cabinet door 2 is closed. In other words, a power circuit connected to the magnetron of the microwave range is de-energized by means of such micro-switch when the cabinet door 2 of the microwave range is open.

By the provision of the above micro-switch, microwaves produced by a high-frequency oscillator or magnetron in the range are prevented from leaking from the cooking cabinet of the microwave range, and thereby the user of the microwave range is prevented from being subjected to the harmful microwaves.

In cooking, the food stuff is placed in the cavity or cooking cabinet of the microwave range. Then, the cabinet door 2 is closed so that the hook projections 19 and 19 of the hook members 18 and 18 of the cabinet door 2 engage with the dog projections 21 and 21 of the hook housing 23 of the door-opening frame 16 of the outer casing 1, respectively. At this time, the above-mentioned micro-switch is turned on to energize the power circuit connected to the high-frequency oscillator or magnetron of the microwave range. Then, a starting switch of the microwave range for energizing the magnetron is turned on, so that microwaves are produced while guided to the food stuff to be cooked. After collapse of a predetermined time period established by the user, the time switch of the microwave range is automatically turned off to de-energize the magnetron of the microwave range. At this time, current is still supplied to the power circuit of the microwave range. After completion of the cooking, the push button 4 is depressed on a direction of an arrow shown in FIG. 2 or rightward to cause the push pin portion 4*c* of the push button 4 to push the upper-end portion of the pivotal hook-operating lever 6, whereby the hook-operating lever 6 is rotated clockwise. As a result, the lower-end portion of the hook-operating lever 6 pushes the hook-operating rod 12 in a direction of an arrow shown in FIG. 2 or rightward against the resilient force exerted by the compression spring 15 mounted on the hook-operating rod 12. The thus pushed hook-operating rod 12 in turn pushes the top-end portion of the hook member 18 to rotate the hook member 18 counterclockwise. The rotational motion of the hook member 18 is transmitted to the second hook member 18 through the connecting rod 23 so that the hook projections 19 and 19. of the hook members 18 and 18 are disengaged from the dog projections 21 and 21 of the hook housing 23 of the outer casing 1 respectively, whereby the cabinet door 2 of the microwave range is opened. At this time, the micro-switch is turned off to de-energize the power circuit of the microwave range. After the cabinet door 2 is opened, the hook-operating rod 12 returns to its initial position or retracted position shown in FIG. 1 under the influence of the resilient force exerted by the compression spring 15. On the other hand, the hook members 18 and 18 also return to their initial positions shown in FIG. 1 under the influence of the resilient force exerted by the tension spring 24 biasing the connecting rod 23 at its retracted position. Consequently, when the cabinet door 2 is open, there is no fear that the hook-operating rod 12 is pushed by mistake.

The latch assembly of the present invention for the cabinet door or window of the microwave range has the above construction Consequently, in a condition in which the cabinet door 2 is open, when the push button is pushed by mistake, there is no fear that the micro-switch disposed on the hook housing 23, of the outer casing 1 is turned on to energize the power circuit of the microwave range. Therefore, the user is completely prevented from being subjected to the harmful micro-waves produced in the microwave range. The latch assembly of the present invention is simple in construction and easy in operation, and is sufficiently mounted in the small side clearance between the outer casing 1 and the cooking cabinet contained therein.

What is claimed is:

1. In a latch assembly for a cabinet door or window of an upright-type microwave range provided with an outer casing and a cavity or cooking cabinet contained in said outer casing, said cabinet door being pivotally mounted on a ~~front~~ portion or door-opening frame of said outer casing while provided with a pivotal hook member which is engaged with a dog projection of a hook housing mounted in said door-opening frame of said outer casing, the improvement wherein: said door-opening frame is fixedly mounted on a peripheral portion of said cooking cabinet said door-opening frame is fixedly mounted and a hook-operating lever is pivotally mounted on said door-opening frame having a lower-end portion said rod is slidably mounted one end of a hook-operating rod the other end of which is brought into contact with said pivotal hook member of said cabinet door, said hook-operating rod being normally biased at its retracted position by a spring means; and an upper-end portion of said hook-operating lever is brought into contact with a push pin portion which is integrally formed with a push button in a projecting manner, said push button being mounted in a control panel of the micro-wave range in a retractable manner.

2. The latch assembly for the cabinet door or window of the microwave range as set forth in claim 1, wherein:

said hook-operating rod mounted in said outer casing protrudes from said outer casing toward said cabinet door to disengage said pivotal hook member of said cabinet door from said dog projection of said hook housing mounted in said door-opening frame of said cooking cabinet.

3. The latch assembly for the cabinet door or window of the microwave range as set forth in claim 1, wherein:

when said push button mounted in said control panel of the microwave range is depressed, said push pin portion of said push button pushes the upper-end portion of said hook-operating lever mounted on said door-opening frame of said outer casing so that said hook-operating lever is rotated, whereby the lower-end portion of said hook-operating lever pushes said hook-operating rod so as to protrude the same from said door-opening frame of said outer casing; as a result, said pivotal hook member of said cabinet door is rotated counterclockwise to cause its hook projection to disengage from said dog projection of said hook housing mounted in said door-opening frame of said outer casing; and said cabinet door is provided with a second pivotal hook member which is substantially identical in construction with said pivotal hook member while spaced apart from the same by a predetermined distance and connected therewith through a connecting rod.

4. The latch assembly for the cabinet door or window of the microwave range as set forth in claim 1, wherein:

when said push button mounted in said control panel of the microwave range is depressed, said push pin portion of said push button pushes the upper-end portion of said hook-operating lever mounted on said door-opening frame of said outer casing so that said hook-operating lever is rotated clockwise, whereby the lower-end portion of said hook-operating lever pushes said hook-operating rod so as to protrude the same from said door-opening frame of said outer casing; and once said pivotal hook member of said cabinet door is rotated counterclockwise by the thus protruded hook-operating rod to cause its hook projection to disengage from said dog projection of said hook housing mounted in said door-opening frame of said outer casing, the protruded hook-operating rod is withdrawn into said door-opening frame of said outer casing.

5. The latch assembly for the cabinet door or window of the microwave range a set forth in claim 2 wherein:

when said push button mounted in said control panel of the microwave range is depressed, said push pin portion of said push button pushes the upper-end portion of said hook-operating lever mounted on said door-opening frame of said outer casing so that said hook-operating lever is rotated clockwise, whereby the lower-end portion of said hook-operating lever pushes said hook-operating rod so as to protrude the same from said door-opening frame of said outer casing; as a result, said pivotal hook member of said cabinet door is rotated counterclockwise to cause its hook projection to disengage from said dog projection of said hook housing mounted in said door-opening frame of said outer casing; and said cabinet door is provided with a second pivotal hook member which is substantially identical in construction with said pivotal hook member while spaced apart from the same by a predetermined distance and connected therewith through a connecting rod.

6. The latch assembly for the cabinet door or window of the microwave range as set forth in claim 2 wherein:

when said push button mounted in said control panel of the microwave range is depressed, said push pin portion of said push button pushes the upper end portion of said hook-operating lever mounted on said door-opening frame of said outer casing so that said hook-operating lever is rotated clockwise, where by the lower-end portion of said hook-operating lever pushes said hook-operating rod so as to protrude the same from said door-opening frame of said outer casing; and once said pivotal hook member of said cabinet door is rotated counterclockwise by the thus protruded hook-operating rod to cause its hook projection to disengage from said dog projection of said hook housing mounted in said door-opening frame of said outer casing, the protruded hook-operating rod is withdrawn into said door-opening frame of said outer casing.

7. The latch assembly for the cabinet door or window of the microwave range as set forth in claim 3 wherein: when said push button mounted in said control panel of the microwave range is depressed, said push pin portion of said push button pushes the upper end portion of said hook-operating lever mounted on said door-opening frame of said outer casing so that said hook-operating lever is rotated clockwise, whereby the lower-end portion of said hook-operating lever pushes said hook-operating rod so as to protrude the same from said door-opening frame of said outer casing; and once said pivotal hook member of said cabinet door is rotated counterclockwise by the thus protruded hook-operating rod to cause its hook projection to disengage from said dog projection of said hook housing mounted in said door-opening frame of said outer casing, the protruded hook-operating rod is withdrawn into said door-opening frame of said outer casing.

8. The latch assembly for the cabinet door or window of the microwave range as set forth in claim 5 wherein: when said push button mounted in said control panel of the microwave range is depressed, said push pin portion of said push button pushes the upper end portion of said hook-operating lever mounted on said door-opening frame of said outer casing so that said hook-operating lever is rotated clockwise, whereby the lower-end portion of said hook-operating lever pushes said hook-operating rod so as to protrude the same from said door-opening frame of said outer casing; and once said pivotal hook member of said cabinet door is rotated counterclockwise by the thus protruded hook-operating rod to cause its hook projection to disengage from said dog projection of said hook housing mounted in said door-opening frame of said outer casing, the protruded hook-operating rod is withdrawn into said door-opening frame of said outer casing.

* * * * *